United States Patent [19]

Thompson

[11] Patent Number: 4,509,639

[45] Date of Patent: Apr. 9, 1985

[54] MULTI-CONTAINER CARRIER PACKAGE AND A METHOD OF ASSEMBLY THEREFOR

[75] Inventor: Mortimer S. Thompson, Arlington, Mass.

[73] Assignee: Tri-Tech Systems International Inc., West Springfield, Mass.

[21] Appl. No.: 364,243

[22] Filed: Apr. 1, 1982

[51] Int. Cl.[3] ..... B65D 71/00

[52] U.S. Cl. ..... 206/159; 206/160; 206/427; 206/504; 220/23.4; 294/87.2

[58] Field of Search ..... 206/159, 160, 427, 504, 206/821; 294/87.2; 220/23.4

[56] References Cited

U.S. PATENT DOCUMENTS

| | | | |
|---|---|---|---|
| 924,209 | 6/1909 | Wolfer | 220/23.4 |
| 986,660 | 3/1911 | Weathers | 220/23.4 |
| 1,085,104 | 6/1937 | Levinson . | |
| 1,629,871 | 5/1927 | Hornaday . | |
| 2,089,416 | 8/1937 | Pearce | 294/87.2 |
| 2,175,058 | 10/1939 | Knapp | 229/93 |
| 2,440,902 | 5/1948 | Lutey . | |
| 2,611,639 | 9/1952 | Sadeck . | |
| 2,710,219 | 6/1955 | Zalkind . | |
| 2,760,677 | 8/1956 | Arneson . | |
| 2,760,716 | 8/1956 | Weiner . | |
| 2,769,535 | 11/1956 | Bruce . | |
| 2,850,319 | 9/1958 | Nordquist . | |
| 2,853,186 | 9/1958 | Holmberg . | |
| 2,885,839 | 5/1959 | Weiss . | |
| 2,961,123 | 11/1960 | Boydak et al. . | |
| 2,970,729 | 2/1961 | Allen . | |
| 2,996,329 | 8/1961 | Glazer . | |
| 2,998,899 | 9/1961 | Telesca . | |
| 3,003,805 | 10/1961 | Glazer . | |
| 3,031,207 | 4/1962 | Bard | 220/23.4 |
| 3,046,711 | 7/1962 | Harrison . | |
| 3,062,373 | 11/1962 | Reynolds . | |
| 3,084,792 | 4/1963 | Poupitch . | |
| 3,114,496 | 12/1963 | Wilcox . | |
| 3,118,537 | 1/1964 | Copping . | |
| 3,202,448 | 8/1965 | Stern et al. . | |
| 3,225,959 | 12/1965 | Jamison . | |
| 3,302,783 | 2/1967 | Lyon . | |
| 3,330,408 | 7/1967 | Wanderer . | |
| 3,366,265 | 1/1968 | Hesselbarth | 220/23.4 |
| 3,397,003 | 8/1968 | Wherry | 220/23.4 |
| 3,404,505 | 10/1968 | Hohl et al. . | |
| 3,412,887 | 11/1968 | Startwood et al. . | |
| 3,460,863 | 8/1969 | Schaich | 206/427 |
| 3,587,847 | 6/1971 | Graser . | |
| 3,592,500 | 7/1971 | Setzler . | |
| 3,630,350 | 12/1971 | Bolten . | |
| 3,653,504 | 4/1972 | Saumsiegle | 294/87.2 |
| 3,688,899 | 9/1972 | Walter | 206/427 |
| 3,711,145 | 1/1973 | Rapata . | |
| 3,733,100 | 5/1973 | Tanzer . | |
| 3,796,370 | 3/1974 | Speers et al. | 229/93 |
| 3,829,143 | 8/1974 | Bird . | |
| 3,874,502 | 4/1975 | Weaver . | |
| 3,951,259 | 4/1976 | Oglesbee . | |
| 3,985,229 | 10/1976 | Maki | 220/23.4 |
| 4,231,605 | 11/1980 | Newman | 294/87.2 |
| 4,300,681 | 11/1981 | Klygis et al. . | |

FOREIGN PATENT DOCUMENTS

| | | | |
|---|---|---|---|
| 2507823 | of 1975 | Fed. Rep. of Germany | 206/427 |

*Primary Examiner*—William T. Dixson, Jr.
*Assistant Examiner*—Jimmy G. Foster
*Attorney, Agent, or Firm*—Hedman, Gibson, Costigan & Hoare

[57] ABSTRACT

A multi-container carrier package having releasable interlocking integral attachment sites, such as engaging projections and recesses. Preferably each container has a reduced upper portion, such as the neck of a bottle, and the carrier bridges the space between adjacent containers. Further, the integral attachment site on each container is used to position the label for optimum display, and the configuration and location of the integral attachment sites at the upper portions of the container and the ends or sides of the carrier facilitate their assemblage. Also, the interlocking attachment sites and the configuration of the carrier facilitate gripping thereof for lifting and carrying the assembled package and, when desired, for detachment of the containers.

22 Claims, 38 Drawing Figures

FIG. 1
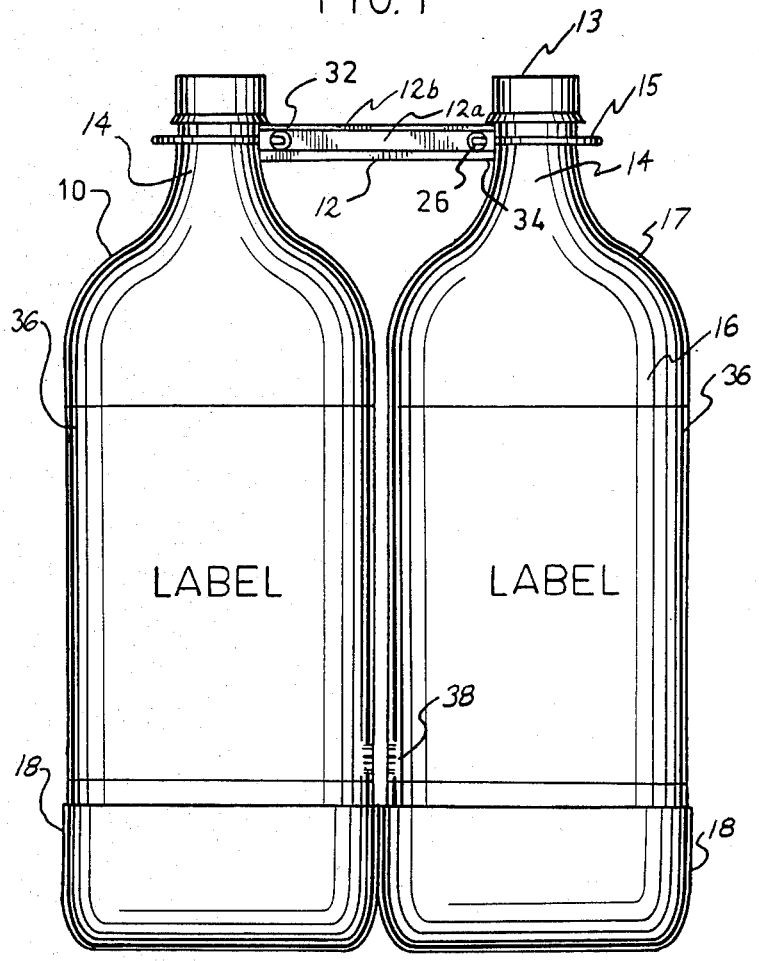
FIG. 3
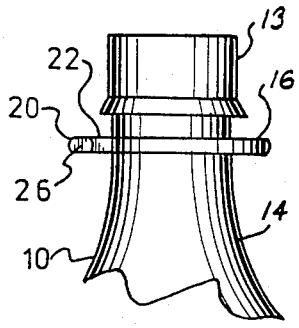
FIG. 4
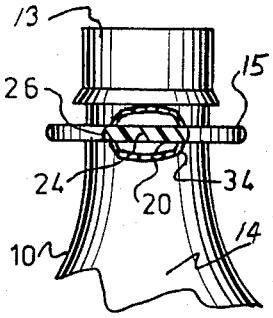
FIG. 5
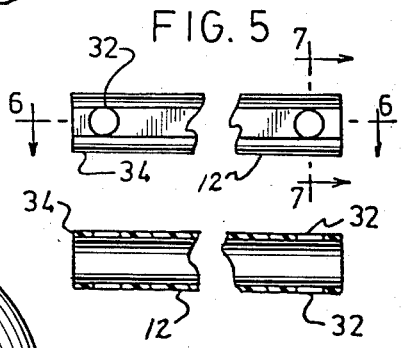
FIG. 2
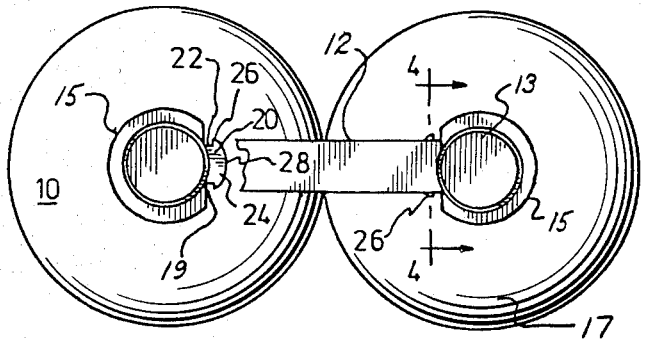
FIG. 6
FIG. 7
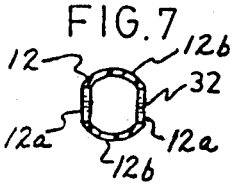

FIG. 12
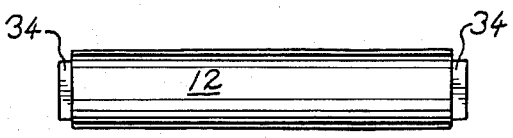
FIG. 13
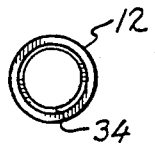
FIG 14
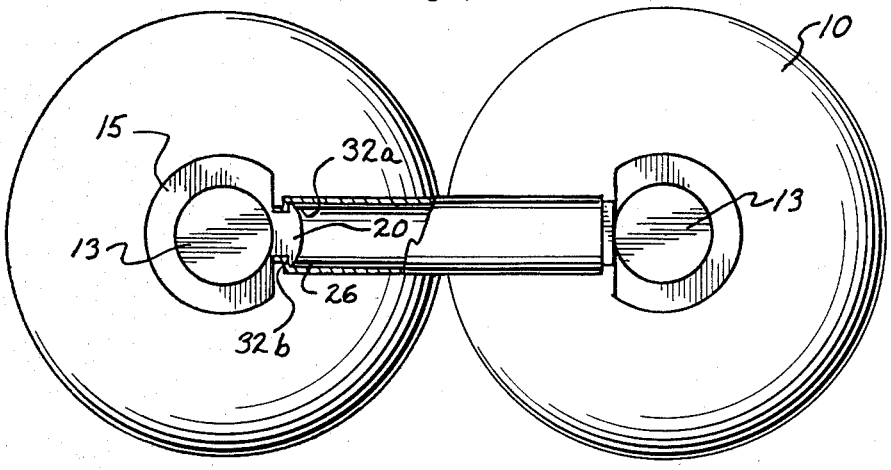
FIG 15
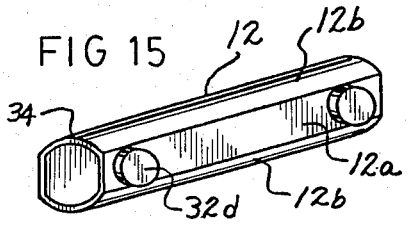
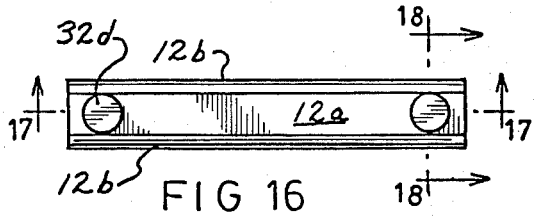
FIG 16
FIG.18
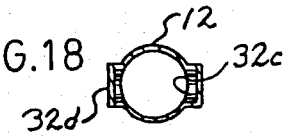
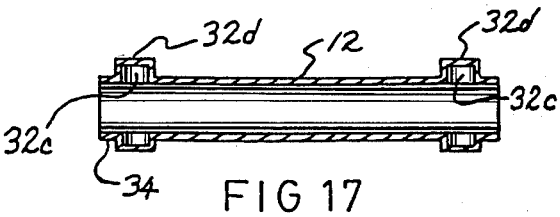
FIG 17
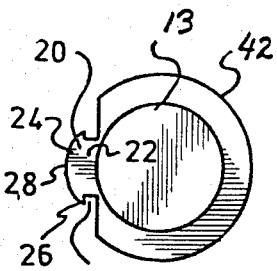
FIG. 19
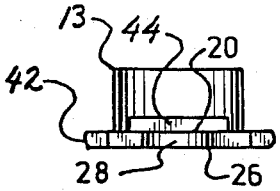
FIG. 20

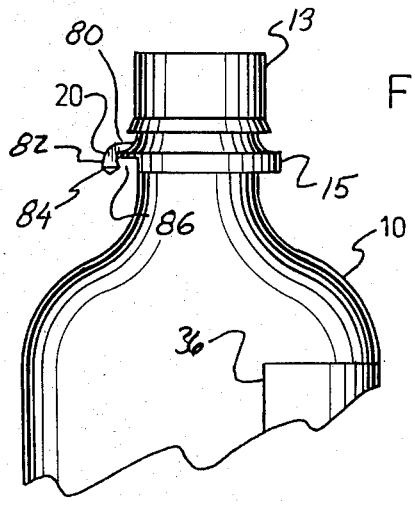
FIG 33
FIG. 34
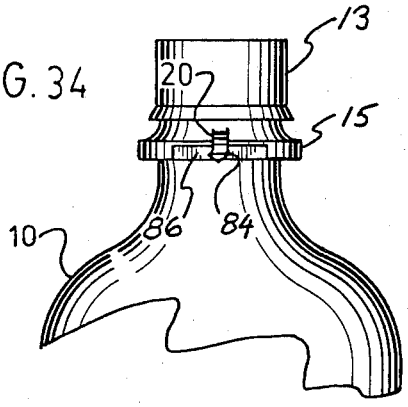
FIG. 35
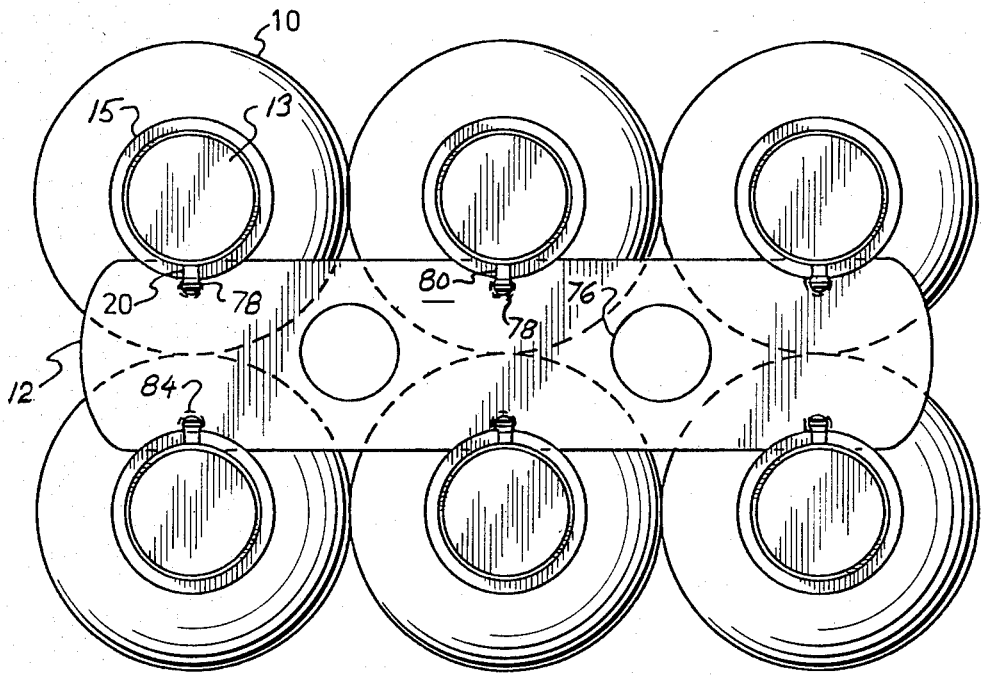
FIG. 36
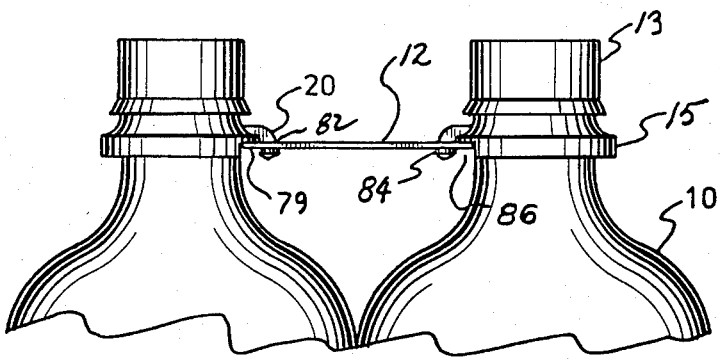

MULTI-CONTAINER CARRIER PACKAGE AND A METHOD OF ASSEMBLY THEREFOR

This invention relates to a multi-container carrier package, and more particularly to a package having a plurality of opposing containers, such as bottles, with integral inwardly facing engaging means at the upper portions of the containers or bottles which releasably interlock with engaging means of a carrier spanning therebetween. The invention also relates to a method of positioning features on the containers relative to their engaging means and of assembling a plurality of containers to the carrier.

BACKGROUND OF THE INVENTION

A variety of container carrying arrangements have been proposed and used for assemblies of two, six, eight and other numbers of containers and bottles. They popularly include baskets, sleeves and wraps of paperboard or carriers of paperboard or plastic which support the upper container portions. While such packaging materials are widely used, they have drawbacks of economy, manufacture and use.

With respect to paperboard baskets, sleeves and wraps, cost penalties are imposed by the large surfaces required to suitably envelop the containers and the heavy duty paperboard which is required to suitably withstand the lifting and carrying stresses. The requirements for strength under wet or humid conditions are poorly met even with more expensive paperboard constructions. Gripping features are provided by slots or holes, making for an uncomfortable and sometimes insecure grip, especially with large size, heavy containers. Also, disassembly of the package calls for the task of ripping the paperboard apart, often creating a highly visible litter problem. Such paperboard baskets, sleeves and wraps have the advantage of providing large surfaces for advertising or promotional display, but the fact that this is accomplished on heavier duty paperboard than needed for simple display purposes is not cost effective.

With respect to paperboard carriers which support the upper container portions, gripping discomfort, wet-strength and disassembly drawbacks are the same as for baskets, sleeves and wraps, while costs are somewhat improved, but with less display surface.

With respect to plastic carriers which support the upper container portions, those which are cut out and folded up from sheet stock, such as those taught by U.S. Pat. No. 4,218,086, are improved in wet-strength over the comparable paperboard carrier, but share the poor gripping comfort and disassembly drawbacks, while typically costing more.

With respect to plastic carriers which support the upper container portions and which are cut from flexible plastic sheet stock, such as low density polyethylene, similar to those taught by U.S. Pat. Nos. 3,711,145, 3,733,100 and 3,874,502, costs are low, but their usefulness is limited generally to small cans, and are less feasible for bottles, particularly large size bottles. Such carriers cut from semi-rigid plastic sheet stock, such as high density polyethylene, may be suitable for some bottles, but not large heavy ones and they are relatively expensive.

With respect to plastic carriers which are injection-molded to provide configurations suitable to support and interlock with the upper container portions, such as those taught by U.S. Pat. Nos. 4,159,841 and 2,996,329, costs are high, and for larger, heavier containers, gripping comfort and detachment ease are poor.

SUMMARY OF THE INVENTION

In accordance with the present invention, there is provided a new and unique package including a plurality of containers and an intermediate bridging carrier in a unitized assembly.

The container has an upper portion with a reduced breadth. Containers particularly suited for the present invention are bottles with reduced necks including larger bottles of the one and two liter size. In each embodiment the upper portion of the container or bottle includes an integral attachment site on or in its periphery which restricts movement of the carrier about the container. In a bottle, for example, the engaging means can be located at or on the reduced neck portion or neck ring, or on the bottle cap releasably secured to the neck. In the embodiment where the projection is part of or formed from the neck ring, its radial and vertical dimensions are similar to the dimensions of the ring.

The carrier of the present invention is adapted to span the space between the containers to be carried and includes integral attachment sites with engaging means generally at its end portions. The carrier can be of a continuous or discontinuous profile of resilient material, including plastic tubes, sheets and other profiles.

The engaging means on the containers and carrier include cooperating, interlocking projections and recesses. For example, the integral engaging means at the upper portion of each container or bottle can be a projection, with recesses at the end portions of the interconnecting bridging carrier, or a recess on each container with projections of the desired configuration at the end portions of the bridging carrier. In each instance the carrier and containers or bottles are attached by interlocking the integral projections and recesses to form a unitized assembly which, by gripping the carrier, can be lifted and carried.

In accordance with a preferred embodiment of the invention, there is provided a package of two bottles or containers with reduced upper portions and a resilient plastic tube. The reduced upper portion of each container or bottle includes a T-shaped projection which is arranged to project into the space therebetween. The tube spans the space between the upper portion of the containers and includes integral engaging means in the wall of the tube at the ends thereof which releasably interlock with the projections of the containers. The package is lifted and carried by gripping the tube with the space between containers providing access to the carrier.

Illustrative embodiments of the carrier of the invention, include a tube having parallel side walls and curved top and bottom walls to faciliate handling, stacking and feeding; a hollow cylindrical tube of uniform wall thickness; a tube having thicker side walls for strength and thinner top and bottom walls for ovalizing; a tube having opposing pockets or square or round holes at each end into which the bottle projections extend; and a tube having annular recesses in the internal walls thereof into which the bottle projections extend. Preferably the length of the tube is selected to only span the space defined by adjacent and confronting upper portions of the container. Preferably the tube does not extend about or around the upper portion or neck of the container or bottle. A more detailed description and advantages of these carriers will be described hereinafter.

In another embodiment of the invention the resilient carrier has a continuous C-shaped profile arranged with the closed end on the bottom and the open end at the top, and includes projections on the inside and at the ends of the tube. In this embodiment each container or bottle includes an L-shaped projection on the periphery of its reduced upper portion which extends outwardly and downwardly to form a recess. With the opening of the C-cross section positioned upwardly, the side walls of the carrier snap fit about an L-shaped projection while the corresponding carrier projection snap fits into its recess.

In each of these instances the carrying ease of the assembled package is enhanced by the small cross section of the carrier gripping portions, the generally rounded contour of the carrier gripping portions, and the ability to use the full span and space between the upper container portions for gripping. In addition, the generally tubular carriers provide superior handling characteristics in stacking, movement and positioning through various stages of their manufacture, transport and automatic machine application to create the assembled package.

In an embodiment, preferably for more than two containers, e.g., four or six, the carrier is a strap having holes adjacent the edges of opposing sides thereof. The strap carrier is suited to engage generally L-shaped projections on the periphery of the upper portions of the containers. Each projection extends outwardly and downwardly and the downward extension has an enlarged head portion that is slightly larger than the strap carrier holes into which it penetrates and interlocks. The interior portions of the strap carrier can have a three-dimensional shape to increase its structural rigidity during lifting and carrying, and holes for finger gripping.

In an important aspect of the invention, container features can be positioned relative to its attachment site. For example, bottle labels of the assembled package can be directed for optimum display while the Universal Product Codes thereon can be hidden from scanning devices by their placement at the site of the general abutment of the containers or bottles. This is accomplished by aligning the attachment site of each bottle relative to the labler so that the label will be properly positioned thereon. In this manner the Universal Product Code feature for the single bottle will be located where the containers or bottles generally abut so that it may be hidden from store check-out scanners, thereby allowing such features placed elsewhere representing the assembled package to be scanned without confusion with the code representing the single bottle.

In addition, the package can include, if desired, resilient wraps, paperboard or billboard thereabout or thereon. These features, however, are ones of choice and generally can be accomplished at significantly lower costs than heretofore experienced where such items are necessary for the integrity of the package.

The bottles of the invention preferably are plastic and can be produced by injection or extrusion blow molding or by injection or extrusion stretch blow molding. The attachment sites of the bottles and containers may be formed by molding or by machining or by a combination of both.

The carriers of the invention preferably are plastic and can be made by extrusion with subsequent punching, stamping or other machining operation or by blow molding, injection molding or other suitable molding methods.

A feature of the invention is that the carrier manufacturing costs are low because their length need be only that which is required to span between the attachment sites located on a portion of the upper container or bottle periphery rather than the added length and breadth needed to gird the full upper container or bottle portion periphery typical of other carriers. When the carrier is a tube, costs are further lowered because of the structural strength of the tubular shape which permits carriers to be of very light weight. When the carrier is a continuous profile, costs are further lowered by the low mold and other manufacturing costs associated with the extrusion process.

In assembly, moreover, the interlocking engagement between the carriers and the containers of the invention is achieved by easy manipulation of the respective assembly components either manually or by apparatus. In practice the ends of the tubular carriers of the invention can be ovalized to facilitate the interlocking engagement.

Also, the containers or bottles can be separated from the carrier as desired by easy manipulation of the interlocking engaging means, including ovalizing of the tubular carriers. The separation can be accomplished with or without destroying the carrier. In the latter instance the intact carrier can be reused. In any event very little debris is created in consumer use.

Another aspect of the invention is that creation of the attachment sites on the bottle need not intrude on normal handling of single bottles by the bottler or the consumer.

Other and additional embodiments of the carriers and containers or bottles of the invention and methods of forming and assembling the package of a plurality of containers or bottles with an intermediate interlocking carrier will become apparent from the following illustrative embodiments and from the accompanying claims.

DESCRIPTION OF ILLUSTRATIVE EMBODIMENTS OF THE INVENTION

The following is a detailed description together with accompanying drawings of illustrative embodiments of the invention. It is to be understood that the invention is capable of modification and variation apparent to those skilled in the art within the spirit and scope of the invention.

In the drawings:

FIG. 1 is a front elevational view of a two bottle carrier package of the invention in which the carrier is attached to the neck ring of the bottles;

FIG. 2 is a plan view of the package of FIG. 1;

FIG. 3 is a side elevational view of the neck portion of the bottle in FIG. 1;

FIG. 4 is a sectional view of FIG. 2, taken along the lines of 4—4, of the neck bottle portion;

FIG. 5 is a front elevational view of the tubular carrier of FIG. 1;

FIG. 6 is a longitudinal sectional view of FIG. 5, taken along the lines of 6—6 thereof;

FIG. 7 is a cross sectional view of FIG. 5, taken along the lines of 7—7 thereof, illustrating the parallel side walls and the curved top and bottom walls of the carrier;

FIG. 12 is a front elevational view of a blow molded tubular carrier of the invention;

FIG. 13 is a cross sectional view of the carrier of FIG. 12;

FIG. 14 is a plan view of the assembled package, partly in section, showing the interlocking engagement between the projections of the bottles and the carrier of FIGS. 12 and 13;

FIG. 15 is a perspective view of another embodiment of the carrier including pockets at its end for engagement with the attachment sites of a container of the invention;

FIG. 16 is a front elevational view of the carrier of FIG. 15;

FIG. 17 is a longitudinal sectional view of the carrier, taken along lines 17—17, of FIG. 16;

FIG. 18 is a cross sectional view of the carrier, taken along lines 18—18, of FIG. 16.

FIG. 19 is a plan view of a bottle cap of the invention, including a projection which is the attachment site for a container;

FIG. 20 is a front elevational view of the bottle cap of FIG. 22;

FIG. 33 is a side elevational view of the upper portion of a container of the invention illustrating another embodiment of the integral engaging means of the present invention;

FIG. 34 is a rear elevational vlew of the bottle of FIG. 33;

FIG. 35 is a plan view of a multi-container carrier package including the bottles shown in FIGS. 32 and 33;

FIG. 36 is a front elevational view of the upper portion of the package of FIG. 35;

Figure 8:
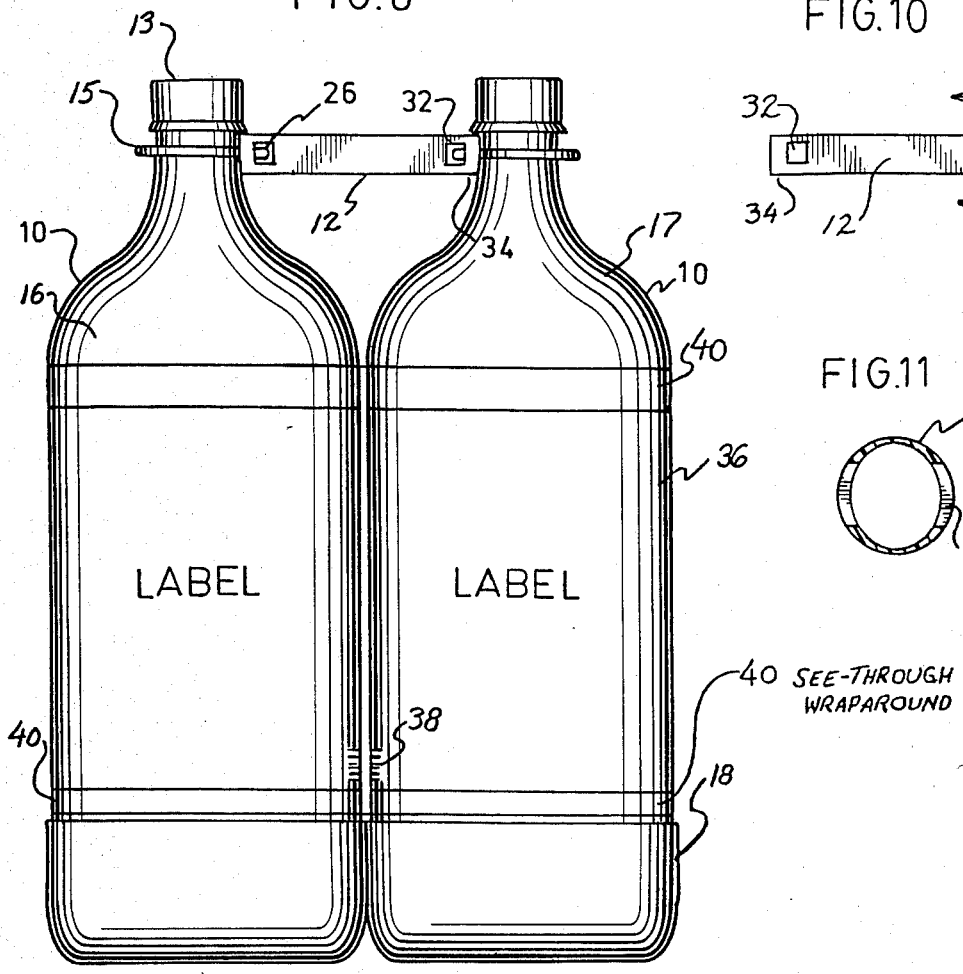
FIG. 8 is the front elevation of another embodiment of the two bottle carrier package of the invention including an intermediate restraining means.

Referring to FIGS. 1 to 7, there is shown a package of the present invention including two bottles 10 and a bridging carrier 12 spanning the space therebetween.

The bottles 10 can be formed from plastic or glass. Each bottle 10 includes a closure cap 13 threaded on the neck finish (not shown), a depending neck 14 of reduced diameter, a neck ring 15 about the neck 14 immediately below the threaded finish, an intermediate enlarged body 16 connected to the neck 14 by a shoulder 17, and a base cup 18 within which the bottle 10 rests. The neck ring 15 includes notches 19 (FIG. 2) to form a horizontal T-shaped projection 20 having a stem 22 extending from the neck 14 and a cross bar portion 24 ending in tips 26. The central projection end 28 is curved so that the cross bar portion 24 forms a circular segment defined by a chord and its intersected arc.

As shown, the radial dimension of the projection 20 essentially is equal to the radial dimension of the neck ring 15, and its vertical dimension essentially is equal to the thickness of the ring 15. In other words, the radial and vertical dimensions of the projections 20 and the neck ring 15 are substantially the same. With these dimensions changes do not have to be made in standard bottle manufacturing processes and filling lines.

The carrier 12 is a hollow tube formed from plastic, and includes opposing lateral holes 32 located near each end 34 of the carrier 12. The tubular carrier 12 extends between and engages the bottle projections 20 by a snap fit engagement of the outer cross bar tips 26 with and through the carrier holes 32.

The width of projection stem 22 preferably is slightly larger than the internal diameter of carrier 12 (e.g. stem width about 0.60 inch; internal tube breadth about 0.50 inch), and the cross bar portion tips 26 extend through the lateral holes 32 slightly beyond the ovalized outside diameter of carrier 12 (e.g. cross bar length about 0.75 inch; tube ovalized breadth about 0.65 inch). The tips 26 of the cross bar 24 have a smaller cross section than the carrier holes 32 with which they engage to effect the assembly. Illustratively, the length of the carrier 12 can be from about 1.5 inches to about 4.0 inches depending on neck and bottle diameter. As shown, the bottles 10 are of a two liter size and the length of the tubular carrier 12 is about 3.5 inches.

In this embodiment, moreover, the tubular carrier 12 includes parallel side walls 12*a* and curved top and bottom walls 12*b*, to facilitate handling, stacking and feeding prior to and during assembly of the package. For example, the parallel side walls 12*a* align the tubular carrier 12 so that the holes 32 are in the required horizontal plane for assembly to the horizontal projections 20.

Engagement of the carrier 12 with a T-shaped projection 20 of each bottle 10 can be accomplished by squeezing carrier ends 34 to create an oval shape with opposing holes 32 spread apart. Thereafter the projection 20 is inserted into carrier end 34 so that carrier holes 32 are aligned with cross bar tips 26, whereupon the carrier end 34 is released to allow it to spring back toward its circular cross sectional shape and securely engage the cross bar tips 26 in carrier holes 32. To disengage the carrier tube 12 from a projection 20, carrier end 34 can again be squeezed to create an oval and spread carrier holes 32 apart, thereby releasing or freeing the cross bar tips 26. What has just been described for engaging and disengaging one end 34 of the carrier 12 can and is repeated to engage and disengage the other carrier end 34 to and from the other projection 20.

Another method of engagement of a tubular carrier end 34 with a T-shaped projection 20 of the bottle 10, includes placing the carrier end 34 in a line with projection end 28 and forcing the carrier end 34 and projection end together, to thereby ovalize and spread the carrier end 34 so that it slides over and beyond cross bar tips 26 which are securely engaged by carrier holes 32 in the snap-fit engagement. Also, each carrier end 34 can be squeezed simultaneously with the insertion of projection end 28 to facilitate the engagement.

Still another method of engagement of the tubular carrier 12 with each projection 20, includes aligning a carrier end 34 approximately normal to a projection 20, rotating the bottle 10 through an arc of about 90 degrees so that one of the cross bar tips 26 engages the interior portion of carrier end 34, first engaging one of the carrier holes 32, and then spreading or ovalizing the carrier end 34 sufficiently to slide completely into carrier end 34 and engage the opposite carrier hole 32 in a snap-fit engagement. Each carrier end 34 can be squeezed simultaneously with the rotation of bottle 10 to facilitate the engagement with each projection 20.

In each instance the interlocking between the specific attachment sites, e.g., projection 20 and holes 32, restricts relative horizontal and vertical movement of the tubular carrier 12 and relative rotational movement of the bottle 10. By so doing the carrier 12 remains affixed to the bottles 10 and features on the bottles, such as labels, remain properly positioned.

As shown in FIG. 1, wrap-around labels 36 encircle the individual bottles 10 of the package about the bottle body 16. Each label 36 has been located on the bottle 10 in registration with or relative to its projection 20 so that it will face outwardly for optimum display in the package. This can be accomplished by maintaining an appropriate alignment of the projection 20 as its bottle 10 is fed into the bottle labeler, or by other mechanical, optical, sonic or other sensing means. Included on label 36 is a Universal Product Code feature 38. By positioning the label 36 with the Code feature 38 directly under projection 20 the abutting packaged bottles will hide the code 38 from market checkout scanning devices.

Figure 9:
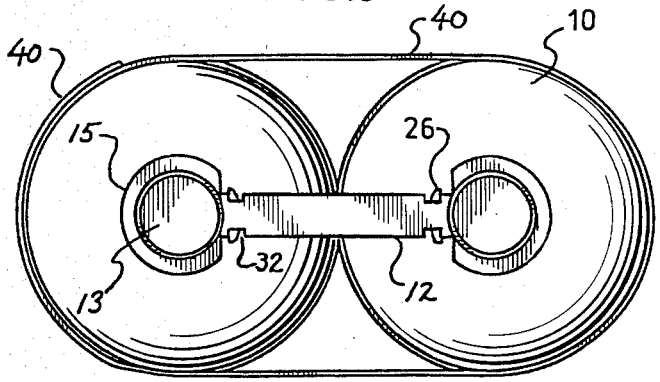
FIG. 9 is a plan view of FIG. 8.

Referring now to FIGS. 8 and 9, there is shown an intermediate bottle assembly restraining means 40 of transparent or see through plastic film that has been wrapped and simultaneously stretched around the assembled bottles 10. The film of the restraining means desirably has the characteristic of adhering to itself as a result of additives, surface treatment or other means typical of conventional stretch films. The film, having been stretched during the wrapping operation, is typically elongated a minimum of about 25 per cent and is in a high tensile state for holding the intermediate and lower assembly portions tightly together during carrying. The restraining means 40 can be transparent to show the labels 36 or it can be opague and provide a suitable labeling or promotional space for the package.

In another embodiment, the restraining means 40 can be made of less extensible materials, such as paper, and not be stretched during application to the bottle assembly. This restraining means can be made to adhere to itself with adhesives.

Figure 10:
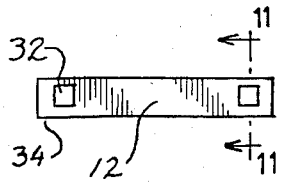
FIG. 10 is a front elevational view of the carrier of FIG. 8, including the square holes for receiving the projections of the bottle.
Figure 11:
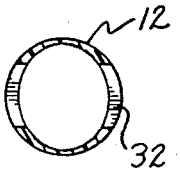
FIG. 11 is an enlarged cross sectional view of FIG. 10, illustrating the tubular carrier with thicker side walls.

As shown in FIGS. 10 and 11, the carrier 12 for this package is a tube and includes square lateral holes 32 which provide latitiude for radial alignment with the cross bar 24 of the projection 20. In this embodiment the side walls of the tube are thicker for strength and the top and bottom walls are thinner for ovalizing.

In the ensuing FIGS. 12 to 17 other embodiments of the tubular carrier 12 of the invention are illustrated. FIGS. 12 to 14 show a blow molded tubular carrier 12 having a central gripping portion and open end portions 34 of reduced diameter creating internal annular recesses **32*a*. This carrier 12 is attached to bottles 10 by squeezing or otherwise ovalizing the carrier ends 34 so that they slide over and engage the previously described projections 20 by means of the engagement of carrier annular recess ledge 32*b* with the cross bar tips 26. Inasmuch as the annular recesses 12*c* can be engaged by the projection 20 at any point, their assembly is accomplished without specific radial alignment thereof. Once assembled, moreover, the carrier 12 can rotate about the interlocking projections 12** and thereby obviate rotational stresses.

In FIGS. 15 to 18 another blow molded tubular carrier 12 is illustrated, including parallel, flat sidewalls **12*a* curved top and bottom walls 12*b*, and internal opposing pockets 32*c* within bosses 32*d* at the carrier ends 34. This carrier can be used in place of carrier 12 of FIGS. 1 to 7** in the practice of the invention.

Referring now to FIGS. 19–22, there is shown a twin bottle carrier package (FIGS. 21–22) in which the integral engaging means for the bottle 10 is included in the closure of bottle cap 13 (FIGS. 19–20). In this embodiment the neck ring 15 is continuous and conventional, inasmuch as it does not contain an attachment site for the carrier 12. As shown, the bottles 10 are the same as those of FIGS. 1–9. In this embodiment, however, the carrier 12 is a hollow cylinder having a uniform wall thickness (FIG. 23).

The cap 13 has a lower annular skirt or ring 42 interrupted by notches 19 to form the T-shape projection 20 with its stem portion 22 and cross bar portion 24 having the outwardly curved central portion 28 and the end tips 26. The cap 13 also includes a slot 44 above and open to the skirt 42 at the projection 20 which acts to divert the lifting stresses imposed by carrier 12 on cap 13. This results in equal and opposing stresses which greatly reduces the potential for disruption of the seal integrity of cap 13 with bottle 10.

As shown, the cap 13 is used with carrier 12 in the same manner as described when the projection 20 was part of the neck ring 15 of the bottles 10 of FIGS. 1 to 9.

Figure 22:
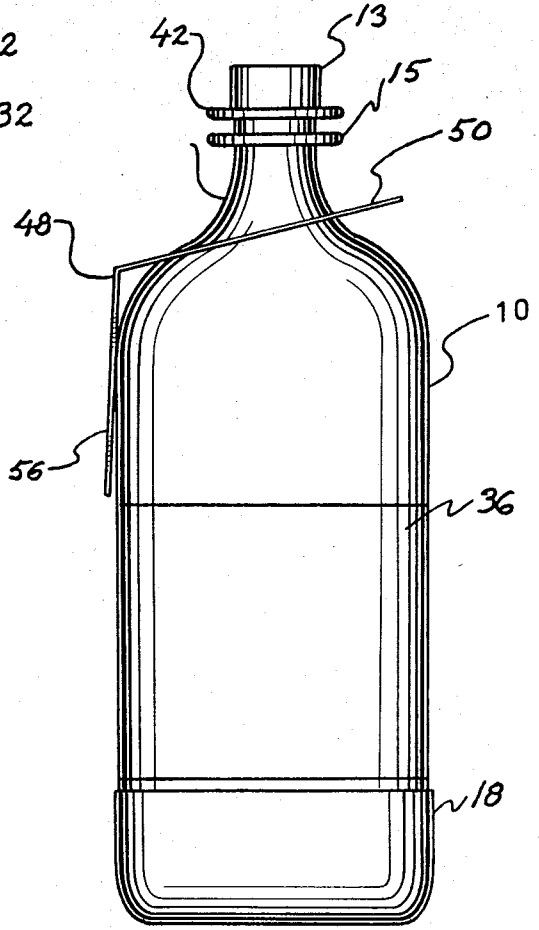
FIG. 22 is a side elevational view of the package of FIG. 21.
Figure 23:
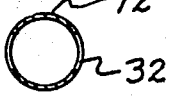
FIG. 23 is an enlarged cross sectional view of the carrier of FIGS. 21, taken along lines 23—23 thereof.
Figure 21:
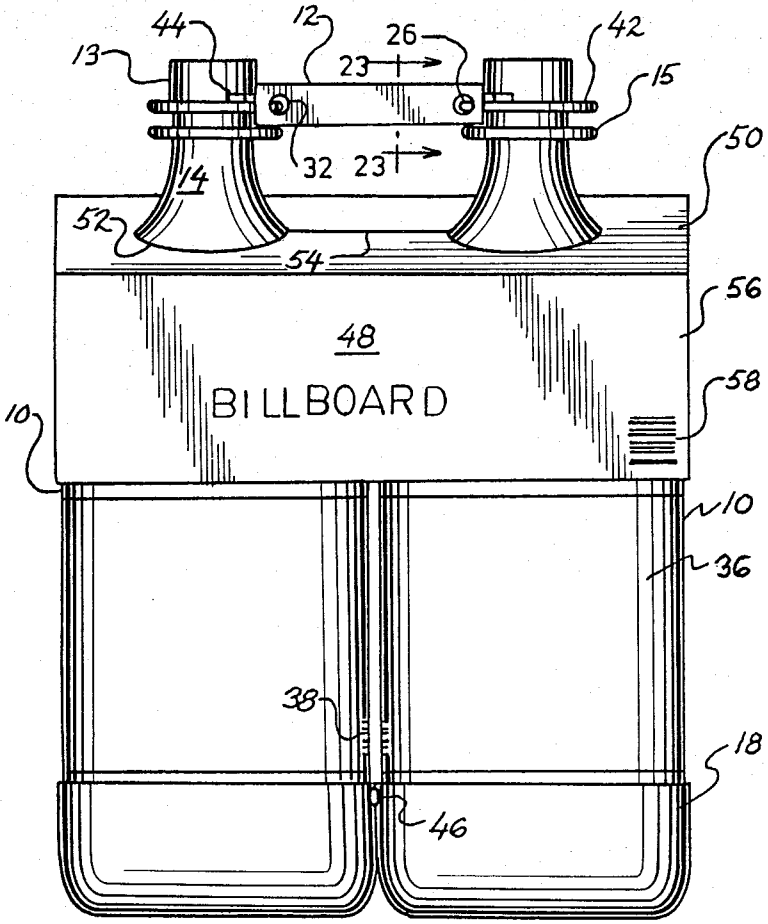
FIG. 21 is a front elevational view of another multi-container carrier package of the present invention including the closure caps of FIGS. 19-20 and billboard about the upper portion of the bottles.
Figure 24:
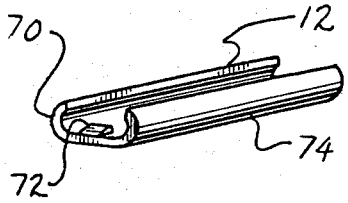
FIG. 24 is a perspective view of another bottle carrier of the present invention.
Figure 25:
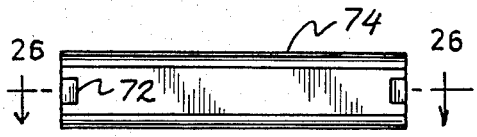
FIG. 25 is a top view of the bottle carrier of FIG. 24.
Figure 26:
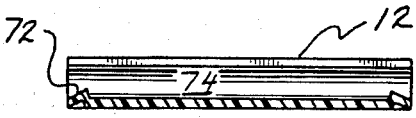
FIG. 26 is a sectional view of FIG. 25, taken along the lines 25—25 thereof.
Figure 27:
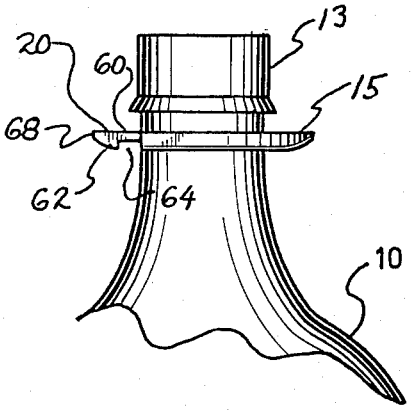
FIG. 27 is a side elevational view of an upper portion of a bottle of the present invention for use with the bottle carrier of FIGS. 24 to 26.
Figure 28:
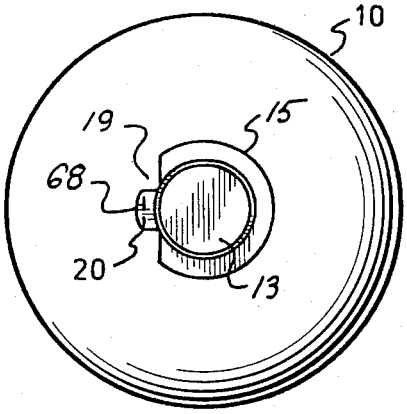
FIG. 28 is a plan view of FIG. 27.

As shown in FIGS. 21 and 22, the bottles 10 include a lower bottle assembly restraining means 46. In this embodiment the restraining means 46 is a spot weld produced by heat or other means to releasably attach the abutting lower portions of the plastic base cups 18 of the bottles 10. This restraining means 46 can be removed when desired by simply pulling the bottles 10 apart. In addition to spot welding, the restraining means 46 can be provided by joining the base cups 18 by adhesive or other similar means.

In FIGS. 21 and 22 there is provided for illustrative purposes, an optional L-shaped billboard 48 having a generally horizontal portion 50 with holes 52 for accepting the bottle neck portions 14, and with an intermediate slit 54 between holes 52 to permit its application after the assembly has been made. Generally, the vertical portion 56 can be used for display of advertising and the Universal Product Code 58 for the package. Moreover, the vertical portion 56 of the billboard can be extended further downwardly to cover all portions of the bottle labels 36, including the Universal Product Codes 38 which generally are hidden in the abutting area of the assembled bottles 10.

In the embodiment of the invention shown in FIGS. 24 to 32, the package includes two bottles 10, a bottle carrier 12 and an intermediate restraining means 40.

Each bottle 10 has a cap 13 and a neck ring 15 interrupted by notches 19 to form an integral L-shaped projection 20. The projection 20 has an outwardly directed portion 60 and a downwardly directed portion 62 which forms a recess 64. The end 68 of the projection 20 is curved outwardly to facilitate insertion of projection 20 into the bottle carrier 12.

Figure 30:
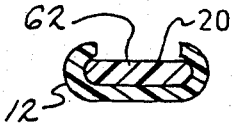
FIG. 30 is a cross sectional view of FIG. 29, taken along the lines 30—30 thereof.

The carrier 12 in this instance has a continuous profile with a C-shaped cross section 70. The carrier 12 includes inwardly directed beveled projection 72 at its ends and on the inside of the closed bottom which is opposite to the open top. The beveled projection 72 slides past portion 62 of the projection 20 and forms a snap-fit engagement in the recess 64. The interior dimensions of C-shaped carrier cross section 70 is close to the exterior dimensions of the cross section of the bottle projection 20 so that a snug fit is accomplished between bottle carrier 12 and bottle projection 20 as shown in FIG. 30. The spring action of the resilient bottle carrier C-shaped cross section allows its side walls 74 to open slightly to facilitate engagement of bottle carrier 12 as the beveled projection 72 slides past the projection downward portion 62 to form the snap-fit engagement.

Figure 29:
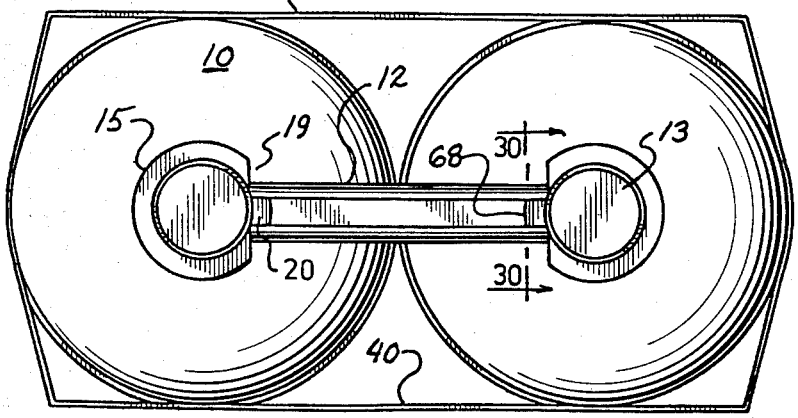
FIG. 29 is a plan view of the multi-container carrier package including the carrier and bottles of FIGS. 24 to 28 with paperboard about the bottles.
Figure 31:
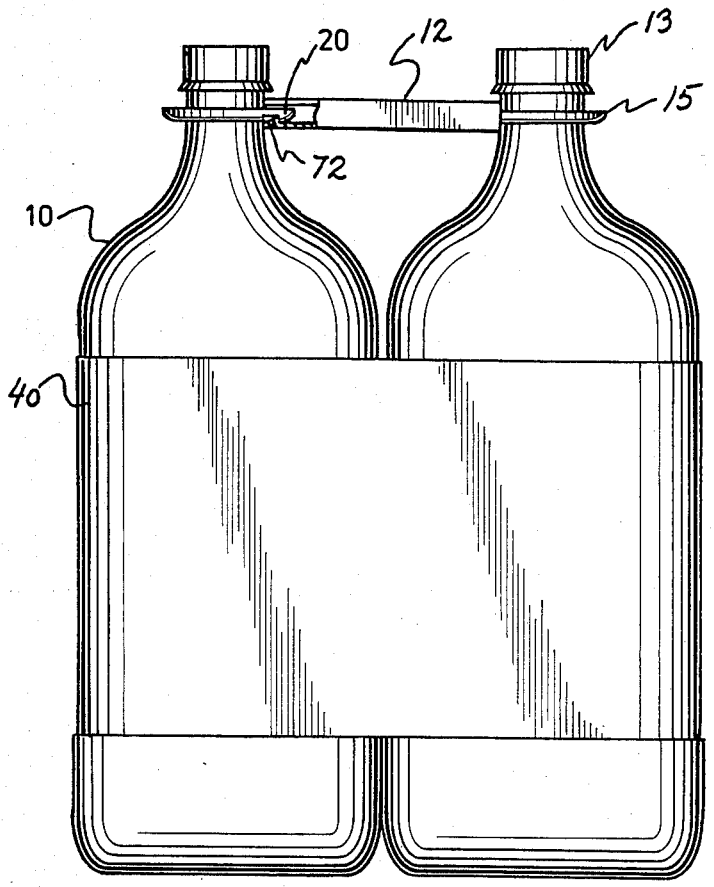
FIG. 31 is a front elevational view of the package of FIG. 29, partly in section, to show the carrier-bottle engagement.
Figure 32:
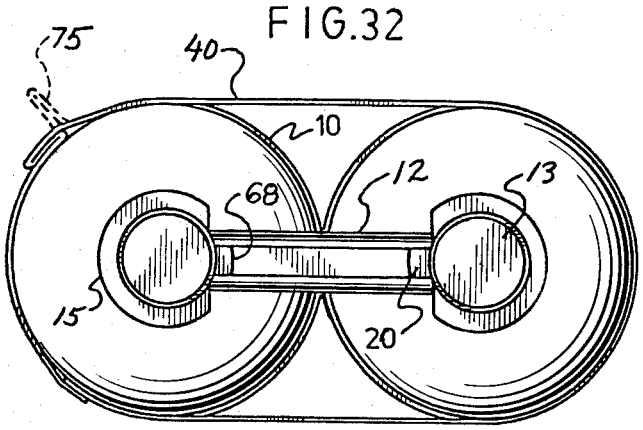
FIG. 32 is a plan view of FIG. 31.
Figure 37:
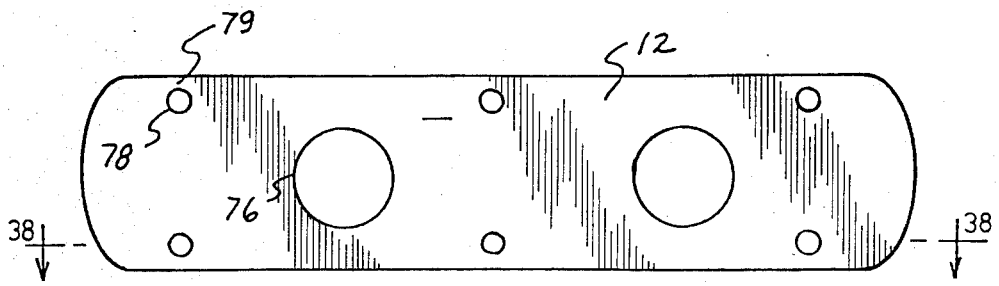
FIG. 37 is a plan view of the carrier of FIGS. 35 and 36.
Figure 38:
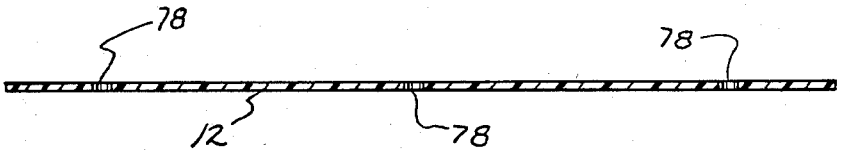
FIG. 38 is a sectional view of FIG. 37, taken along the lines of 38—38 thereof.

As shown in FIGS. 29, 31 and 32, the package can include a restraining means 40 of paperboard, folded and seamed to form a generally rectangular shape (see FIG. 29). The restraining means 40 can be left as applied, and as shown in FIG. 29, serve as a loose restraint as well as a display area. As shown in FIGS. 31 and 32, the restraining means 40 also can be tightened about the assembly to provide a greater restraint to movement of the bottles 10 during carrying. In order to tighten the restraining means 40, it is pulled tight in one corner, creating a flap 75 as shown in phantom in FIG. 32, which is subsequently folded back against and adhered to the main body of restraining means 40.

Referring now to FIGS. 33 to 38, there is shown a package of the present invention for six bottles 10 attached to the bottle carrier 12.

The bottle carrier 12 is a strap of resilient material having central finger holes 76 and six bottle engaging holes 78 separated from the carrier edge by the carrier edge portion 79. There are three opposing holes 78 on each side.

Each bottle 10 has a neck ring 15 which has an L-shaped projection 20 extending outwardly 80 and downwardly 82, with an enlarged downwardly directed head 84 that is slightly larger than the bottle engaging holes 78 of the carrier 12. Between the enlarged projection end 84 and the bottle neck 14 is a recess 86 formed by reducing the thickness of a portion of neck ring 15 adjacent to the projection 20. The recess 86 accepts the carrier edge portion 79 when projection ends 84 are inserted through and engaged by carrier holes 78. Thereafter the bottle assembly may be gripped, lifted and carried by the thumb and forefinger using carrier finger holes 76.

Also shown are labels 36 registered or positioned on the bottles 10 opposite the projections 20 by maintaining an appropriate alignment of projections 20 as the bottles 10 are fed into the bottle labeler.

In this, as in other embodiments, the six bottles 10 and strap carrier 12 interlock to restrict undesirable carrier and bottle movement during storage, display and handling.

With respect to the bottles and carriers of the present invention, they can be used to contain and carry a wide variety of beverage products, including carbonated drinks, fruit juices and drinks, beer, milk and water. Also, the number of bottles carried can vary, e.g., two, four, six, eight, etc.

With respect to producing glass bottles 10 of the invention, they can be formed by any of the several techniques, including blow and blow, and press and blow techniques.

With respect to producing the plastic bottles 10 of the invention, they can be formed by any of several molding techniques, including extrusion, blow-molding and injection blow molding. Stretch blow-molding is a desirable technique because the desirable properties of resulting from the biaxial orientation of the plastic bottles. A wide variety of materials can be used to form the bottles 10 depending on such factors as cost, strength, product capability, etc. These materials include polyethylene, polypropylene, polyethylene terephthalate, polyvinyl chloride, etc.

With respect to materials for forming the carriers 12, these include the same or other plastics used for forming the bottles. Inasmuch as the carriers 12 are formed separately, these materials can be dissimilar to those of the bottles 10, and can be specifically selected to maximize the properties of the carriers, such as resiliency, toughness and stiffness. For example, polypropylene or high density polyethylene carriers 12 would provide suitably high levels of toughness, stiffness and close dimensional tolerance for optimum performance during attachment.

In addition, where desired, these carriers 12 can be of a different color than the bottle 10. Also, the carriers 12 can be formed from scrap materials that may not be otherwise used.

The attachment sites for the containers and bottles of the invention can be produced by melt forming in the injection or blow molds associated with plastic and glass bottle and cap manufacturing processes, or by machining the neck ring, cap or other portions, including die punching and other cutting methods after the bottle has been produced.

The carriers can be produced by extrusion molding, blow molding, injection molding and other hot or melt forming methods with attachment sites, either molded into the carrier or subsequently machined into it by stamping, cutting or other suitable means.

The invention in its broader aspect is not limited to the specific described embodiments and departures may be made therefrom within the scope of the accompanying claims without departing from the principals of the invention and without sacrificing its chief advantages.

I claim:

1. A two container carrier package in which the carrier is attached to the containers, comprising:

two containers, each of which includes an upper portion of reduced breadth and an integral attachment site with engaging means at said upper portion which restricts movement of the attached carrier about the container, and wherein said containers are adjacent one another with said reduced upper portions forming a space therebetween with said engaging means at said upper portions extending inwardly toward one another, and a hollow tubular carrier, which spans only the space between the reduced upper portions of adjacent containers and which substantially lies in the horizontal plane therebetween, and includes ends of resilient material having integral attachment sites, wherein said container engaging means are adapted to extend into said tube ends, and wherein said ends are adapted to be releasably deformed for interlocking said carrier attachment sites about said container engaging means so that said carrier can be gripped for lifting and carrying the assembled package without disengagement of said containers and, when desired, to release said interlocking carrier attachment sites and container engaging means so that said containers can be removed from said carrier.

2. A two container carrier package in which the carrier is attached to the containers, comprising:

two containers, each of which includes an upper portion of reduced breadth and an integral attachment site with a projecting engaging means at said upper portion which restricts movement of the attached carrier about the container, and wherein said containers are adjacent one another with the lower portions thereof in a generally abutting relationship and with said reduced upper portions forming a space therebetween with said projecting engaging means at said upper portions extending inwardly toward one another for engagement to the carrier, and a hollow tubular carrier of resilient material, which spans only the space between the reduced upper portion of adjacent containers and which substantially lies in the horizontal plane therebetween, and incldues ends having integral attachment sites, wherein said projecting container engaging means are adapted to extend into said tube ends, and wherein said ends are adapted to be ovalized for interlocking said carrier attachment sites about said container engaging means so that said carrier can be gripped for lifting and carrying the assembled package without disengagement of said containers and, when desired, to release said interlocking carrier attachment sites and container engaging means so that said containers can be removed from said carrier.

3. The two container carrier package of claim 2, wherein said attachment sites of said carrier are recesses at the ends thereof into which said projecting container engaging means extend for interlocking.

4. The two container carrier package of claims 1 or 2, wherein the containers comprise a material selected from the group consisting of glass and plastic.

5. The two container carrier package of claims 1 or 2, wherein the containers have a capacity of from about one-eighth to about two liters.

6. The two container package of claims 1 or 2, wherein said attachment site is used to position features positioned in the assembled package.

7. The two container package of claims 1 or 2, wherein said attachment site of each container orients said container for optimum display of features thereon in the assembled package.

8. The carrier package of claim 1 or 2, wherein each of said containers has a removable cap adapted to be secured thereto which idcludes said engaging means.

9. A twin bottle carrier package in which the carrier is attached to the bottle, comprising:

two bottles having neck portions of reduced breadth, each of which has an integral T-shaped projection for attachment to the carrier, wherein the stem of said T-shaped projection extends from said neck portion and said cross bar of said T-shaped projection is spaced from said neck portion, and wherein said bottles are adjacent one another with the lower portions thereof in a generally abutting relationship and with said reduced neck portions forming a space therebetween with said T-shaped projections extending inwardly toward one another to facilitate gripping and attachment of the carrier therebetween, and a tubular carrier of resilient material, which spans only the space between the neck portions of said bottles and which substantially lies in the horizontal place therebetween, and includes attachment sites at the ends thereof which are adapted to releasably deform to facilitate engagement and disgengagement, wherein the stems of said opposing projections extend into the carrier and the cross bars of said projections releasably interlock with said attachment sites thereabout to attach the bottles to said carrier for lifting and carrying the assembled package without disengagement of said bottles and, when desired, to allow said bottles to be easily removed from said carrier upon again releasably deforming said ends.

10. A two bottle carrier package in which the carrier is attached to the bottles, comprising:

two bottles, each of which has a neck portion of reduced breadth and an integral T-shaped projection extending outwardly therefrom which restricts movement of an attached carrier about the bottle, and wherein said bottles are adjacent one another with the lower portions thereof in a generally abutting relationship with said reduced neck portions forming a space therebetween with said T-shaped projections at said neck portions extending inwardly toward one another for attachment to said carrier, and a hollow tubular carrier of a resilient material which only spans the space between the neck portions of said bottles and includes lateral holes at the ends thereof which are ovalized to allow said T-shaped projections to extend into said hollow tubular carrier and through said lateral holes for interlocking therewith so that said carrier can be easily gripped for lifting and carrying the assembled package without disengagement of said bottles and, when desired, to allow said interlocked T-shaped projections to be withdrawn from said lateral holes so that the bottles can be released from said carrier.

11. The twin bottle carrier package of claim 9 or 10, wherein each bottle has an integral neck ring which includes said T-shaped projection.

12. The twin bottle carrier package of claim 9 or 10, wherein each bottle has a cap secured thereto which includes said T-shaped projection.

13. A twin bottle carrier package, comprising:

two bottles, each of which has a neck portion of reduced breadth and an integral L-shaped projection with a portion extending outwardly therefrom and with the other portion depending downwardly therefrom which forms with said outwardly extending portion a recess therebetween, and wherein said bottles are adjacent one another with the lower portions thereof in a generally abutting relationship and with said reduced neck portions forming a space therebetween with said L-shaped projections extending inwardly toward one another for attachment to the carrier and to restrict rotation of the bottles relative to the attached carrier, and a hollow resilient C-shaped tubular carrier extending only between said bottles in a substantial horizontal plane with the closed end of said carrier at the bottom thereof and with the open end at the top thereof, including opposing projections on the inside of said closed ends facing upwardly toward said open end, wherein said L-shaped projection are adapted to extend into said carrier ends and wherein the side walls of said carrier snap fit over and about said L-shaped projections and said carrier projections snap fit into said recesses to allow said carrier to be gripped for lifting and carrying the assembled package without disengagement of said containers and, when desired, to allow the bottles to be removed from said carrier.

14. The twin bottle carrier package of claim 13, wherein each bottle has an integral neck ring which includes said L-shaped projection.

15. The twin bottle carrier package of claim 13, wherein each bottle has a cap secured thereto which includes said L-shaped projection.

16. A multi-bottle carrier package in which the carrier is attached to the bottles, comprising:

a plurality of bottles, each of which has a reduced neck portion and an integral L-shaped projection extending outwardly and downwardly from such neck portion, wherein the downwardly extending portion has an enlarged head at its lowermost end, and wherein the bottles are arranged in pairs with said reduced neck portions forming a space therebetween and with said L-shaped projections facing inwardly toward one another to facilitate gripping and attachment of the carrier therebetween, and a carrier strap of resilient material which bridges the space between the neck portions and includes central finger holes and outer holes along its sides corresponding to the number of bottles to be attached to said carrier and through which the enlarged heads of said integral projections are snap fitted to releasably interlock said bottles thereto and allow the carrier to be gripped by the finger holes for lifting and carrying the package without disengagement of the bottles and, when desired, to allow the bottles to be removed from the carrier.

17. The multi-bottle carrier package of claim 16, wherein said carrier has four or six bottles attached thereto.

18. The carrier package of claims 1, 2, 10, 9, 13 or 16; wherein said carrier is formed from plastic.

19. The carrier package of claims 10, 9, 13 or 16, wherein the bottles comprise a material selected from the group consisting of glass and plastic.

20. The carrier package of claims 10, 9, 13 or 15, wherein the bottles have a capacity of from about one-eighth to about two liters.

21. The carrier package of claims 10, 9, 13 or 16, wherein said attachment site is used to position features on said bottle so that they will be properly positioned in the assembled package.

22. The carrier package of claims 10, 9, 13 or 16, wherein said attachment site of each bottle orients said bottle for optimum display of features thereon in the assembled package.

* * * * *